US011145442B2

(12) United States Patent
Pan

(10) Patent No.: US 11,145,442 B2
(45) Date of Patent: Oct. 12, 2021

(54) EXTERNALLY CONTROLLED THERMAL TRIP DEVICE, METHOD AND APPLICATION FOR VARISTORS

(71) Applicants: Shanghai ASP Lighting Protective Technology Co., Ltd., Shanghai (CN); MERSEN USA EP Corp., Boonton, NJ (US)

(72) Inventor: Ting Pan, Shaanxi (CN)

(73) Assignees: Shanghai ASP Lighting Protective Technology Co., Ltd., Pudong (CN); MERSEN USA EP Corp., Boonton, NJ (US)

( * ) Notice: Subject to any disclaimer, the term of this patent is extended or adjusted under 35 U.S.C. 154(b) by 0 days.

(21) Appl. No.: 16/956,737

(22) PCT Filed: Jan. 22, 2018

(86) PCT No.: PCT/CN2018/073637
§ 371 (c)(1),
(2) Date: Jun. 22, 2020

(87) PCT Pub. No.: WO2019/140691
PCT Pub. Date: Jul. 25, 2019

(65) Prior Publication Data

US 2020/0402689 A1 Dec. 24, 2020

(51) Int. Cl.
*H01C 7/12* (2006.01)
*H01C 13/02* (2006.01)

(52) U.S. Cl.
CPC ..... *H01C 7/12* (2013.01); *H01C 13/02* (2013.01)

(58) Field of Classification Search
CPC ..... H01C 7/12; H01C 13/02
See application file for complete search history.

(56) References Cited

U.S. PATENT DOCUMENTS 3,742,419 A * 6/1973 Martzloff ..... H01C 7/102 338/20
6,430,019 B1 * 8/2002 Martenson ..... H01C 7/126 361/103

(Continued)

FOREIGN PATENT DOCUMENTS

CN 2147673 Y 11/1993
CN 1815658 A 8/2006

(Continued)

OTHER PUBLICATIONS

International Search Report from corresponding International Patent Application No. PCT/CN2018/073637, dated Sep. 26, 2018.

*Primary Examiner* — Kyung S Lee
(74) *Attorney, Agent, or Firm* — Kusner & Jaffe

(57) ABSTRACT

An externally-controllable thermal tripping device comprising a voltage dependent resistor including a voltage dependent resistor chip; a thermal tripper including a tripping electrode; and a controllable heating element. The tripping electrode is connected to an electrode of the voltage dependent resistor chip through a meltable welding material, and the controllable heating element is controlled by an external control device to generate heat and transmit generated heat to a commissure of said welding material to melt said welding material and electrically disconnect the tripping electrode from the voltage dependent resistor chip.

9 Claims, 4 Drawing Sheets

(56) References Cited

U.S. PATENT DOCUMENTS

| | | | | |
|---|---|---|---|---|
| 2006/0145807 | A1* | 7/2006 | Gautier | H01H 37/52 337/36 |
| 2007/0025044 | A1* | 2/2007 | Golubovic | H02H 9/042 361/124 |
| 2012/0105191 | A1* | 5/2012 | Wang | H01T 1/14 337/414 |
| 2013/0038976 | A1* | 2/2013 | Hagerty | H01C 7/126 361/104 |
| 2014/0232512 | A1* | 8/2014 | Yang | H01H 61/02 337/401 |
| 2015/0171622 | A1* | 6/2015 | Lee | H01C 7/126 361/93.7 |
| 2015/0280420 | A1* | 10/2015 | Mao | H01C 7/126 361/91.2 |
| 2016/0204599 | A1* | 7/2016 | Strangfeld | H01H 37/767 361/91.2 |

FOREIGN PATENT DOCUMENTS

| | | | |
|---|---|---|---|
| CN | 101202137 | A | 6/2008 |
| CN | 201733089 | U | 2/2011 |
| CN | 202178743 | U | 3/2012 |
| CN | 202405029 | U | 8/2012 |
| WO | WO 2005/0112050 | A1 | 11/2005 |

* cited by examiner

EXTERNALLY CONTROLLED THERMAL TRIP DEVICE, METHOD AND APPLICATION FOR VARISTORS

FIELD OF THE INVENTION

The present invention relates to a technology for a voltage dependent resistor, particularly to an externally-controllable thermal tripping device applicable to a voltage dependent resistor, a method of operating the same, and an application of the same.

BACKGROUND OF THE INVENTION

Since voltage dependent resistors (VDRs) can prevent apparatuses from being damaged by overvoltage conditions, such as lightning or overvoltage in a power grid, they are widely applied in various fields. However, an aging VDR may short-circuit, fail to work and induce a fire. Therefore, failure and short circuit of the VDR should be controlled in time. There is a technology, i.e., the safety VDR, available in the market, including the thermal protection VDR and the thermally protected metal-oxide varistor (TPMOV), wherein the VDR generates heat before failure; the generated heat is used to melt the connection between the VDR and the circuit, whereby the current is cut off. Another technology uses a thermal tripping structure to form a surge protection device (SPD), which can provide a tripping instruction. The thermal protection part of the related device absorbs the heat generated by the VDR and cuts off the circuit before the VDR catches fire. Thereby, the VDR can protect other electronic devices, and the safety of the VDR application is enhanced. Below, the application of a VDR in surge protection devices (SPDs) is used to explain the function of the VDR.

The short-circuit protection function of the SPD uses a thermal protection tripper and a VDR chip (metal oxide varistor, MOV) to cut off power. While the temperature of the deteriorated electrode of the MOV rises to a specified value, the meltable material of the thermal protection tripper is melted to guarantee that the tripper has cut off power before the housing of the SPD is burned. Therefore, the power would not be cut off unless the MOV has deteriorated and the leakage current is large enough to generate so high a temperature that the meltable material melts. Before the abovementioned case, while the leakage current of the deteriorated MOV is still insufficient to melt the low-temperature welding material, lightning or overvoltage is likely to directly puncture the MOV and result in a short circuit. The short-circuited MOV has almost zero resistance. Therefore, leakage current or malfunction current would not generate heat in the short-circuited MOV. Consequently, the tripper fails to work, and a fire may occur.

SUMMARY OF THE INVENTION

The present invention provides an externally-controllable thermal tripping device applicable to a VDR, a method of operating the same, and an application of the same to overcome the conventional problems of the VDR.

According to a first aspect, in one embodiment, the present invention provides an externally-controllable thermal tripping device applicable to the VDR, which comprises a VDR chip and a thermal tripper and is characterized in further comprising a controllable heating element, wherein a tripping electrode of the thermal tripper is connected to an electrode of the VDR chip through a meltable welding material, and wherein the controllable heating element is controlled by an external control device to generate heat and transmits the generated heat to a commissure (i.e., junction, joint or surface) of the meltable welding material to melt the meltable welding material and make the tripping electrode of the thermal tripper electrically disconnected from the VDR chip.

In one embodiment, the external control device controls the controllable heating element to generate heat according to a condition wherein the VDR chip malfunctions and/or an element deteriorates, or a preset condition.

In one embodiment, the controllable heating element and the thermal tripper are fabricated into an integral structure.

In one embodiment, the controllable heating element and the thermal tripper are connected to each other in a dismountable way.

In one embodiment, the commissure between the controllable heating element and the meltable welding material is formed by heat conduction.

In one embodiment, the thermal tripping device of the present invention is characterized in further comprising at least one temperature sensor, wherein the temperature sensor is disposed at a position where a surface temperature of the VDR chip can be measured and/or a position where a temperature of the controllable heating element can be measured.

In one embodiment, the thermal tripping device of the present invention is characterized in further comprising a separating plate, wherein the separating plate is disposed between the tripping electrode of the thermal tripper and the VDR chip, and wherein the controllable heating element transmits heat to the commissure of the meltable welding material, and wherein while the meltable welding material is melted, the separating plate is pushed into a position between the tripping electrode of the thermal tripper and the electrode of the VDR chip to make the tripping electrode of the thermal tripper electrically disconnected from the VDR chip.

According to a second aspect, in one embodiment, the present invention provides a method of operating an externally-controllable thermal tripping device applicable to a VDR, which comprises the steps:

disposing a controllable heating element, which can be controlled externally, inside the VDR;

controlling the controllable heating element to generate heat;

the controllable heating element transmitting heat to a commissure of a meltable welding material inside the VDR; and the VDR actively performing thermal separating while the meltable welding material is melted.

In one embodiment, the VDR is a voltage dependent resistor including the abovementioned externally-controllable thermal tripping device.

In an aspect of cooperative manufacturers, the present invention provides an application of a VDR, wherein the VDR includes the abovementioned externally-controllable thermal tripping device and is applicable to thermal protection apparatuses.

According to the abovementioned embodiments of the externally-controllable thermal tripping device, the external control device can control the controllable heating element to generate heat autonomously, whereby the thermal tripper can be actively separated from the VDR chip. For example, while the VDR chip deteriorates or another element ages, the external control device controls the controllable heating element to generate heat to melt the meltable welding material and make the thermal tripper separated from the VDR chip. Thereby, the safety and reliability of the apparatus using the VDR is enhanced.

Figure 1:
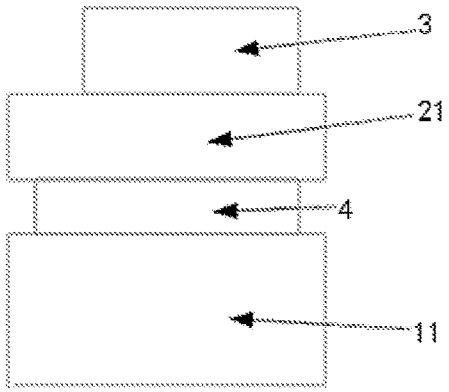
FIG. 1 is a diagram schematically showing an interior structure of an externally-controllable thermal tripping device according to one embodiment of the present invention.

Below, embodiments of the present invention are described in detail with reference to the drawings to further demonstrate the present invention.

DETAILED DESCRIPTION OF THE INVENTION

The present invention provides an externally-controllable thermal tripping device applicable to a VDR, which is characterized in an active and controllable tripping technology of a VDR, to overcome the safety problems resulting from the conventional passive tripping technology.

In one embodiment, the externally-controllable thermal tripping device comprises a VDR chip 1, a thermal tripper 2, and a controllable heating element 3. A tripping electrode 21 of the thermal tripper 2 is connected to an electrode 11 of the VDR chip 1 through a meltable welding material 4. For example, the welding material 4 is a low-temperature solder; the tripping electrode 21 of the thermal tripper 2 is welded to the electrode 11 of the VDR chip 1 through the low-temperature solder. The controllable heating element 3 is controlled by an external control device to generate heat. For example, the external control device controls the controllable heating element 3 to generate heat in response to a condition that the VDR chip 1 malfunctions and/or an element deteriorates. Therefore, the controllable heating element 3 actively generates heat in response to a condition that the VDR chip 1 malfunctions and/or an element deteriorates. For example, the external control device may actively control the controllable heating element 3 to generate heat according to the detected malfunction current of the VDR 1. In another example, the external control device may actively control the controllable heating element 3 to generate heat according to the detected deterioration of other elements. In a further example, the external control device may actively control the controllable heating element 3 to generate heat according to a preset condition. The preset condition may be a special requirement of a user. Thereby, the controllable heating element 3 may be controlled to generate heat actively. The controllable heating element 3 transmits the generated heat to a commissure (i.e., junction, joint, or surface) of the welding material 4 to melt the welding material 4, whereby the tripping electrode 21 of the thermal tripper 2 is electrically disconnected from the VDR chip 1. Therefore, the externally-controllable thermal tripping device can provide a tripping function.

According to the abovementioned design, the disconnection of the thermal tripper from the VDR chip 1 can be actively controlled in the present invention. In the present invention, the disconnection of the thermal tripper from the VDR chip 1 is via controlling the controllable heating element 3 to generate heat to melt the welding material 4. The conventional technology uses the malfunction current of the VDR chip to generate heat and melt the welding material 4. If the VDR chip 1 has deteriorated, the leakage current thereof is not necessarily sufficient to melt the welding material 4. In such a case, if the VDR chip 1 suffers a lightning strike or experiences an overvoltage condition, the VDR chip 1 may break down and short-circuit. The resistance of the short-circuited VDR chip 1 is almost zero, and the short-circuited VDR chip 1 does not generate heat for leakage current or malfunction current. It may make the tripper fail to work and cause a fire. In the present invention, the disconnection of the thermal tripper from the VDR chip 1 is via controlling the controllable heating element 3 to generate heat to melt the welding material 4. Therefore, the present invention can prevent a fire caused by the failure of the tripper, a fire caused by incomplete disconnection of the thermal tripper 2, a fire caused by an unsuccessful disconnection resulting from tremendous short-circuit current damage to the physical structure of the thermal tripper 2 before the thermal tripper 2 completes its operation, and a fire caused by deterioration of the element that makes the external apparatus, which is connected with the VDR, unable to separate from the main power source.

Figure 2:
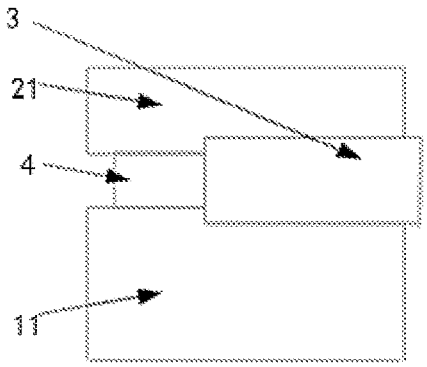
FIG. 2 is a diagram schematically showing an interior structure of an externally-controllable thermal tripping device according to another embodiment of the present invention.

In order to achieve the goals of the present invention, the commissure between the controllable heating element 3 and the welding material 4 should have superior thermal conductivity. Referring to FIG. 1, in one embodiment, the controllable heating element 3 is disposed above the tripping electrode 21 and very near the welding material 4. Referring to FIG. 2, in one embodiment, the controllable heating element 3 is disposed beside the welding material 4 and directly contacts the welding material 4. The present invention does not particularly limit the position of the controllable heating element 3 as long as the commis sure between the controllable heating element 3 and the welding material 4 have superior thermal conductivity. In the present invention, the controllable heating element 3 may be a thermistor, a ceramic heater, or another heat generating material, such as a mica heater or an electric heating filament.

Figure 3:
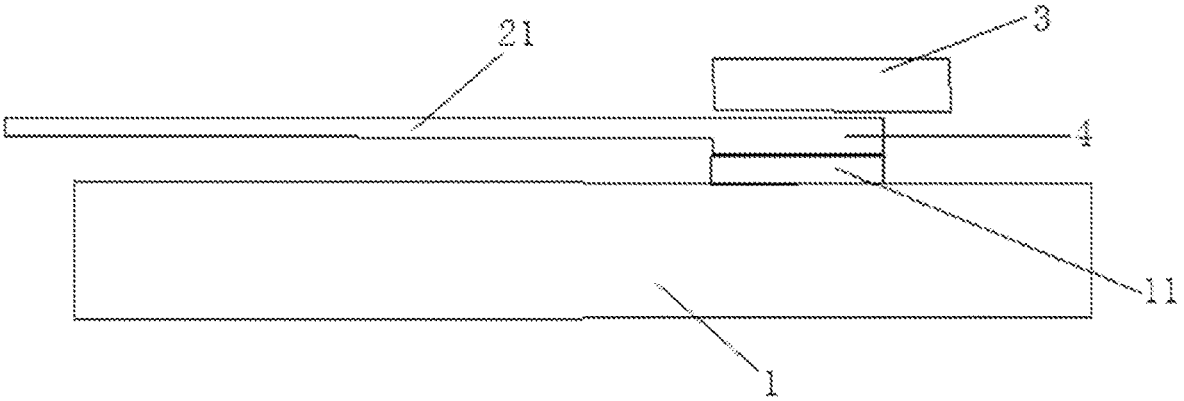
FIG. 3 is a diagram schematically showing a naked design of an externally-controllable thermal tripping device according to one embodiment of the present invention.
Figure 4:
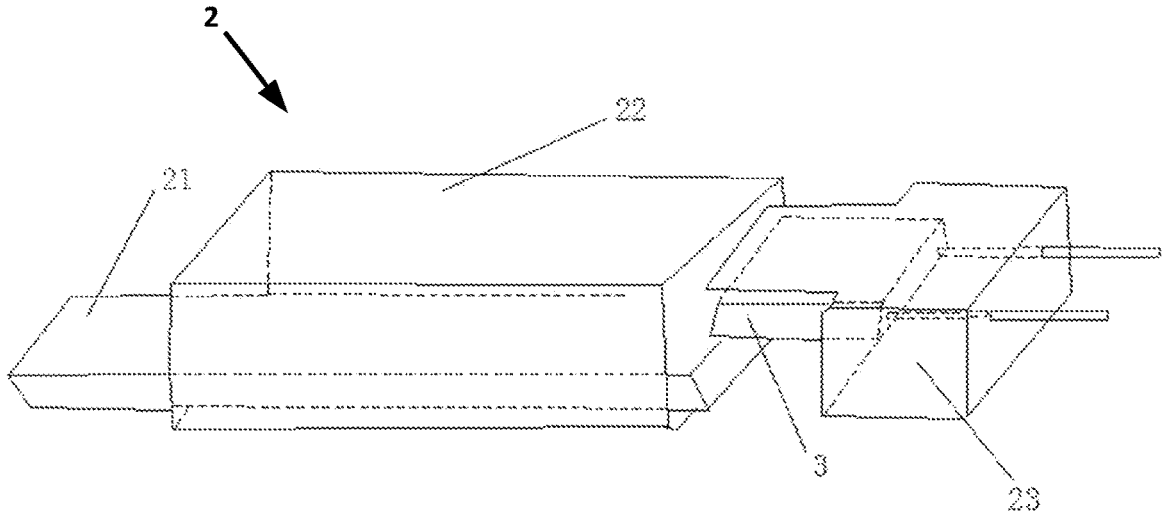
FIG. 4 is a diagram schematically showing a structure of a thermal tripper of an externally-controllable thermal tripping device according to one embodiment of the present invention.

Referring to FIG. 3, in a practical application, the controllable heating element 3, the tripping electrode 21, the welding material 4, and the electrode 11 of the VDR chip 1 are jointly fabricated into a structure. In another embodiment, the thermal tripper 2 is provided with a housing, and the controllable heating element 3 and the thermal tripper 2 are configured as an integral structure. Referring to FIG. 4, the thermal tripper 2 further comprises a first housing 22 and a second housing 23. The tripping electrode 21 is inserted into the first housing 22, and the controllable heating element 3 is inserted into the second housing 23, and then the first housing 21 and the second housing 23 are joined in an insertable way to form an integral structure, whereby the integration of elements is realized.

In another embodiment, the controllable heating element 3 and the thermal tripper 2 are connected in a detachable way, whereby the elements can be conveniently changed.

Figure 5:
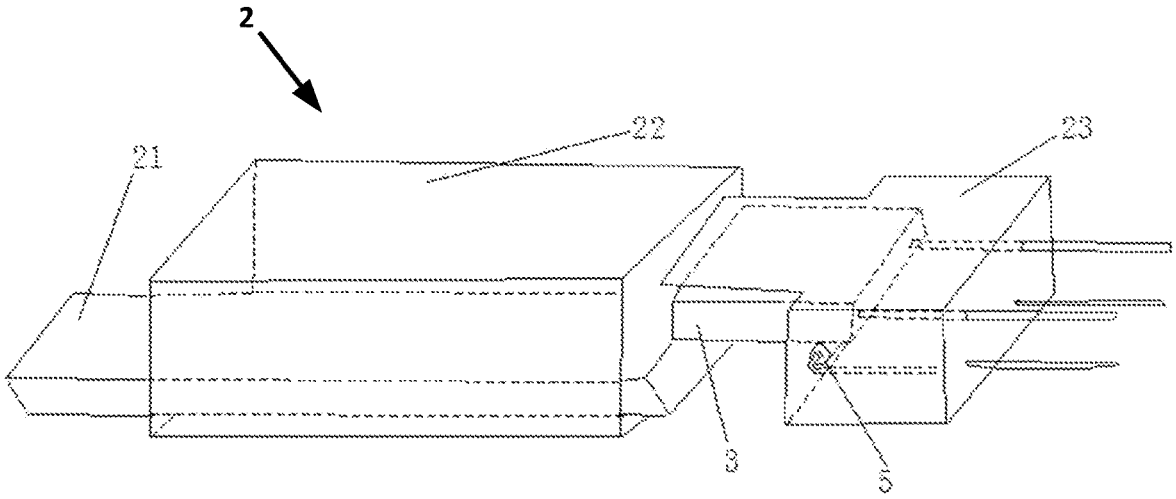
FIG. 5 is a diagram schematically showing a structure of a thermal tripper of an externally-controllable thermal tripping device according to another embodiment of the present invention.

In order to control the controllable heating element 3 more effectively, the present invention further comprises a temperature sensor 5. The temperature sensor 5 is disposed at a position where a surface temperature of the VDR chip 1 can be measured and/or a position where a temperature of the controllable heating element 3 can be measured. Referring to FIG. 5, the temperature sensor 5 is disposed at a position where a temperature of the controllable heating element 3 can be measured. In the embodiment shown in FIG. 5, the temperature sensor 5 is inserted into the second housing 23 and disposed below the controllable heating element 3, and the temperature sensor 5 has signal communication with the external control device. Thereby, the external control device can control the controllable heating element 3 to generate heat according to the SPD (Surge Protection Device) temperature fed back by the temperature sensor 5. The temperature sensor 5 may be an NTC (Negative Temperature Coefficient) temperature measurement element.

Figure 6:
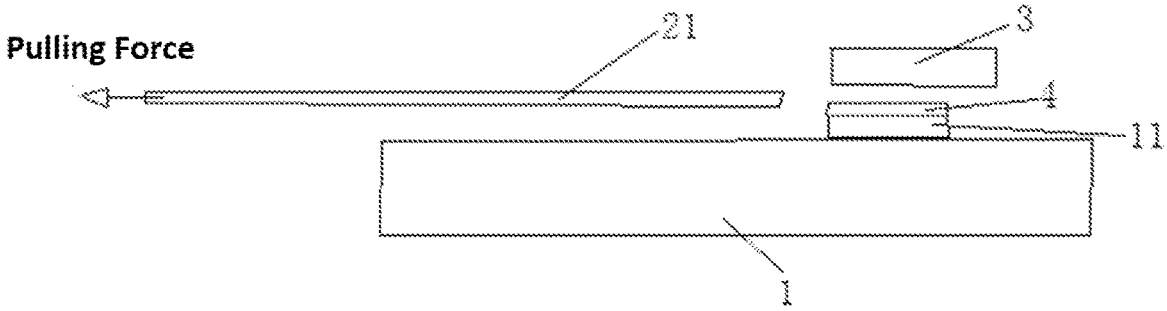
FIG. 6 is a diagram schematically showing disconnection of a thermal tripper and a VDR chip according to one embodiment of the present invention.
Figure 7:
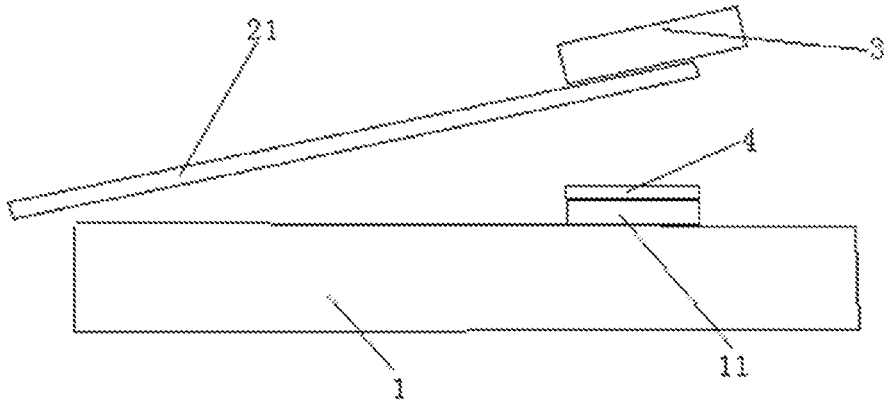
FIG. 7 is a diagram schematically showing disconnection of a thermal tripper and a VDR chip according to another embodiment of the present invention.
Figure 8:
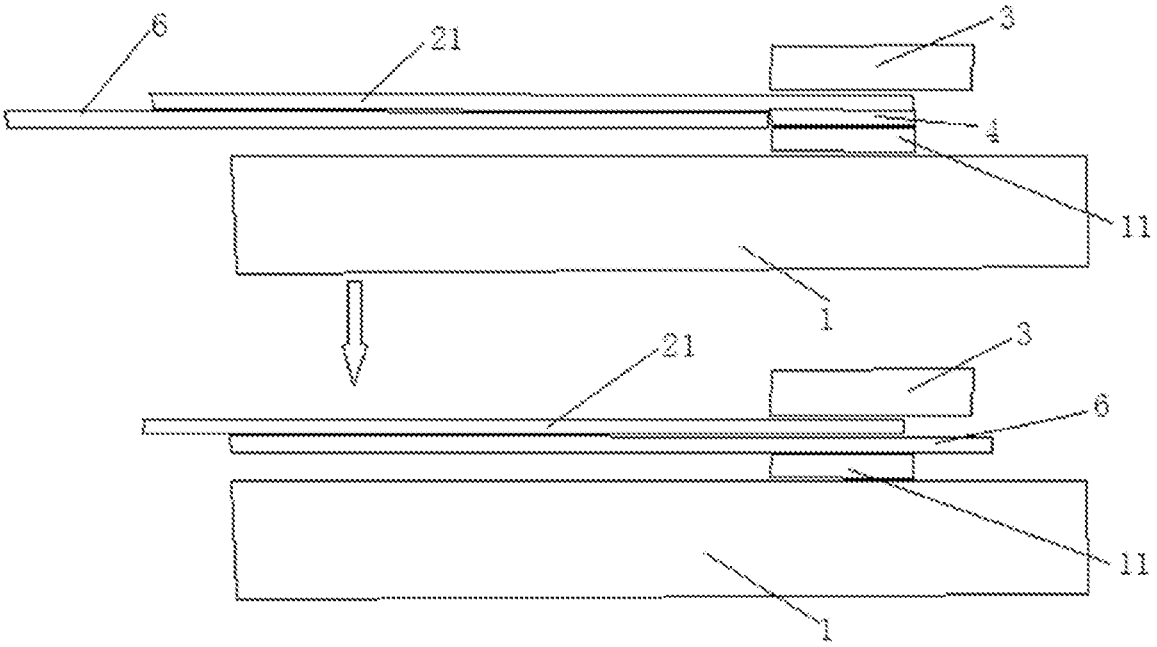
FIG. 8 is a diagram schematically showing disconnection of a thermal tripper and a VDR chip according to still another embodiment of the present invention.

Referring to FIG. 6 and FIG. 7, the welding material 4 is melted by the heat coming from the controllable heating element 3, and an external pulling force separates the thermal tripper 2 from the VDR chip 1. Referring to FIG. 8, the welding material 4 is melted by the heat coming from the controllable heating element 3, and the thermal tripper 2 may be separated from the VDR chip 1 by an external pushing force. It should be further understood that the present invention does not require that the thermal tripper 2 must be separated from the VDR chip 1 by a pulling force or a pushing force. In the present invention, the thermal tripper 2 may be separated from the VDR chip 1 by another force, such as an elastic force.

While an external pushing force is used to separate the thermal tripper 2 from the VDR chip 1, it is preferred that the present invention further comprises at least one separating plate 6. The separating plate 6 is disposed between the tripping electrode 21 of the thermal tripper 2 and the VDR chip 1, and the commis sure of the welding material 4 hinders the separating plate 6 from separating the thermal tripper 2 and the VDR chip 1. In such a case, the external control device may control the controllable heating element 3 to generate heat to the commissure of the welding material 4. While the welding material 4 is melted, the separating plate 6 is pushed to a position between the tripping electrode 21 of the thermal tripper 2 and the electrode 11 of the VDR chip 1, whereby the tripping electrode 21 of the thermal tripper 2 is electrically disconnected from the VDR chip 1. Thus, the separating plate 6 completes the separating function and separates the thermal tripper 2 from the VDR chip 1.

Figure 9:
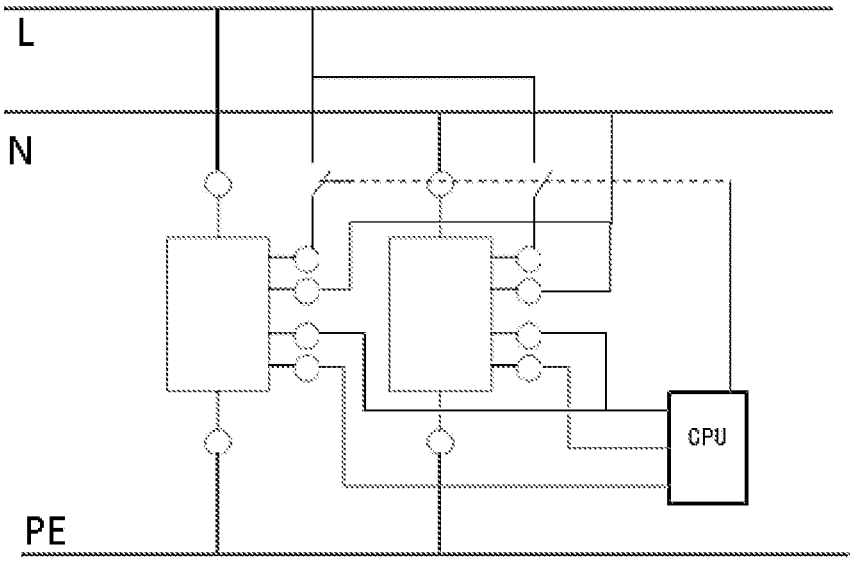
FIG. 9 is a diagram schematically showing an externally-controllable thermal tripping device applied to a circuit according to one embodiment of the present invention.

Referring to FIG. 9, there is shown a circuit using the externally-controllable thermal tripping device of the present invention, wherein the external control device, such as CPU, actively controls the controllable heating element 3 to generate heat to melt the welding material 4 and thus realize the goal of separating the thermal tripper 2 from the VDR chip 1.

The structure of the externally-controllable thermal tripping device applicable to VDR of the present invention has been described above. The method for externally controlling a thermal tripping device applicable to VDR of the present invention will be described below. In one embodiment, the method of the present invention comprises the following steps:

disposing a controllable heating element 3, which can be controlled externally, inside a VDR;

controlling the controllable heating element 3 to generate heat. For example, controlling the controllable heating element 3 to generate heat in response to a condition that the VDR chip 1 malfunctions and/or an element deteriorates, or a preset condition;

the controllable heating element 3 transmitting heat to a commissure of a meltable welding material inside the VDR; and the VDR actively performing thermal separating while the meltable welding material is melted.

In the present invention, the VDR is a voltage dependent resistor having the abovementioned externally-controllable thermal tripping device, such as a thermally-protected VDR or a thermally-protected metal oxide varistor (TPMOV).

Based on the abovementioned externally-controllable thermal tripping device and the method of operating the same, the present invention further provides an application of the VDR, wherein the VDR includes the abovementioned externally-controllable thermal tripping device and is applicable to thermal protection apparatuses, such surge protection devices and fuse blocks.

The embodiments disclosed herein are presented to demonstrate the present invention. However, these embodiments are disclosed only to exemplify and explain the present invention, not to limit the scope of the present invention. According to the specification and the claims of the present invention, persons skilled in the art should be able to make substitutions, modifications and variations in the embodiments of the present invention without departing from the spirit and scope of the present invention.

What is claimed is:

1. An externally-controllable thermal tripping device comprising:

a voltage dependent resistor including a voltage dependent resistor chip;

a thermal tripper including a tripping electrode; and a controllable heating element, wherein the tripping electrode is connected to an electrode of said voltage dependent resistor chip through a meltable welding material, and wherein said controllable heating element is controlled by an external control device to generate heat and transmit generated heat to a commissure of said welding material to melt said welding material and make said tripping electrode electrically disconnected from said voltage dependent resistor chip.

2. The externally-controllable thermal tripping device according to claim 1, wherein said controllable heating element is controlled to generate heat in response to a condition that said voltage dependent resistor chip malfunctions and/or an element deteriorates, or a preset condition.

3. The externally-controllable thermal tripping device according to claim 1, wherein said controllable heating element and said thermal tripper form an integral structure.

4. The externally-controllable thermal tripping device according to claim 3, wherein said commissure between said controllable heating element and said welding material is formed by heat conduction.

5. The externally-controllable thermal tripping device according to claim 1, wherein said controllable heating element and said thermal tripper are connected to each other in a dismountable way.

6. The externally-controllable thermal tripping device according to claim 5, wherein said commissure between said controllable heating element and said welding material is formed by heat conduction.

7. The externally-controllable thermal tripping device according to claim 1 further comprising:

at least one temperature sensor, wherein said at least one temperature sensor is disposed at a position where a surface temperature of said voltage dependent resistor chip can be measured and/or a position where a temperature of said controllable heating element can be measured.

8. The externally-controllable thermal tripping device according to claim 1 further comprising:

a separating plate disposed between said tripping electrode of said thermal tripper and said voltage dependent resistor chip, and wherein said controllable heating element transmits heat to said commissure of said welding material, and wherein while said welding material is melted, said separating plate is pushed into a position between said tripping electrode of said thermal tripper and said electrode of said voltage dependent resistor chip to make said tripping electrode of said thermal tripper electrically disconnected from said voltage dependent resistor chip.

9. A method of operating an externally-controllable thermal tripping device applicable to a voltage dependent resistor, said method comprising:

disposing a controllable heating element, which can be controlled externally, inside said voltage dependent resistor;

controlling said controllable heating element to generate heat;

said controllable heating element transmitting heat to a commissure of a meltable welding material inside said voltage dependent resistor; and said voltage dependent resistor actively performing thermal separating while said meltable welding material is melted.

* * * * *